US012240667B2

(12) United States Patent
Foltz

(10) Patent No.: US 12,240,667 B2
(45) Date of Patent: Mar. 4, 2025

(54) SECURE SHIPPING CONTAINER

(71) Applicant: GLOBAL LINK SOURCING, INC., Murrieta, CA (US)

(72) Inventor: Peter Foltz, Temecula, CA (US)

(73) Assignee: Global Link Sourcing, Inc., Murrieta, CA (US)

( * ) Notice: Subject to any disclaimer, the term of this patent is extended or adjusted under 35 U.S.C. 154(b) by 22 days.

(21) Appl. No.: 16/744,053

(22) Filed: Jan. 15, 2020

(65) Prior Publication Data

US 2020/0223602 A1 Jul. 16, 2020

Related U.S. Application Data

(60) Provisional application No. 62/793,038, filed on Jan. 16, 2019.

(51) Int. Cl.

*B65D 50/06* (2006.01)
*B65D 5/32* (2006.01)
*B65D 5/38* (2006.01)

(52) U.S. Cl.

CPC ..... *B65D 50/067* (2013.01); *B65D 5/321* (2013.01); *B65D 5/326* (2013.01); *B65D 5/38* (2013.01); *B65D 2203/10* (2013.01)

(58) Field of Classification Search

CPC ..... B65D 50/067; B65D 5/321; B65D 5/326; B65D 5/38; B65D 5/06; B65D 5/08; B65D 5/16; B65D 5/20; B65D 5/4204; B65D 5/728; B65D 5/725; B65D 7/10; B65D 9/08; B65D 11/12; B65D 2583/0468

USPC ..... 206/804, 91, 676; 229/913

See application file for complete search history.

(56) References Cited

U.S. PATENT DOCUMENTS 3,126,092 A * 3/1964 Maron ..... B65D 85/1036 206/246
3,949,928 A * 4/1976 Perkins ..... B65D 5/28 229/125.125
4,270,692 A * 6/1981 Webinger ..... A61L 9/12 206/0.5
2003/0080012 A1* 5/2003 Chiu ..... B65D 5/4204 206/449
2005/0133397 A1* 6/2005 Mehling ..... B65D 5/4245 206/459.5
2006/0231602 A1* 10/2006 Mu ..... B65D 5/302 229/125.015
2012/0325839 A1* 12/2012 Bates ..... B65D 5/728 221/194
2013/0186804 A1* 7/2013 Miller ..... B65D 5/326 206/769
2018/0257827 A1* 9/2018 Drosos ..... B65D 50/066
(Continued)

*Primary Examiner* — Robert Poon
(74) *Attorney, Agent, or Firm* — Ascus IP Law, P.C.

(57) ABSTRACT

A secure shipping container includes an inner sleeve formed in the shape of a tray that can be inserted into an outer sleeve formed as a tube with one closed end and one open end. The inner sleeve is sized to be shorter than the outer sleeve so that when full inserted into the outer sleeve the contents of the tray are not accessible, and the inner sleeve is not removable without a special opening tool. Each sleeve includes a slot into which an opener can be inserted to permit a user to slide the inner sleeve out of the outer sleeve in order to access the contents of the container. A method of assembly of the components and use to ship materials is also described.

2 Claims, 6 Drawing Sheets

(56) References Cited

U.S. PATENT DOCUMENTS

2019/0359373 A1* 11/2019 Glass ..... B65D 5/5028
2021/0371172 A1* 12/2021 Markarian ..... B65D 59/04

* cited by examiner

SECURE SHIPPING CONTAINER

CROSS REFERENCE TO RELATED APPLICATION

This application claims the benefit under 35 U.S.C. § 119(e) of U.S. Provisional Application No. 62/793,038, filed Jan. 16, 2019, and entitled "Secure Shipping Container," the entirety of which is hereby incorporated by reference.

FIELD OF THE INVENTION

The invention is in the field of shipping containers, in particular containers that are child-proof and designed for carrying materials not intended for children.

BACKGROUND

There are a number of containers for materials designed to prevent access by children or others who might be harmed by exposure to such materials. For example, controlled substance like prescription medications are often provided to consumers in child-proof bottles and like containers, which typically have lids that require complex manipulation to remove. However, while child-proof bottles are suitable for uses such as dispensing pills they are a less desirable solution for shipping materials in bulk.

To overcome this, one solution has been to provide shipping containers with locks or other means of preventing access. However, these add complexity and additional cost in producing such containers and are not as easily used since they typically require a user to have a key or some other specific device to open the container. Thus, what is required in the field is a simpler mechanism to secure a shipping container that is effective to prevent access to the contents of the container, especially where the contents might be hazardous to young children.

SUMMARY OF THE INVENTION

The present disclosure provides a novel shipping container that can be used to securely transport materials and which generally child-proof. The container comprises two components, an inner sleeve in the form of an open top tray into which materials to be shipped can be placed. This tray is insertable into an outer sleeve, which in an example provided herein is a rectangular tube with an open end. The inner and outer sleeves are sized such that when the inner sleeve is inserted into the outer sleeve, a relatively snug fit is achieved, and the inner sleeve is maintained in place by friction between the two components.

Removal of the inner sleeve from the outer sleeve is accomplished by the insertion of an opener into slots formed in the inner and outer sleeves. The length of the inner sleeve slot is sized to about the width of the opener. The outer sleeve slot is significantly longer than the inner sleeve slot such that when the opener is inserted, it engages the inner sleeve which can then be moved by applying a lateral force to the opener as the opener slides in the outer sleeve slot. By moving the inner sleeve a sufficient distance, its contents are made accessible.

The present disclosure thus provides in one embodiment a secure shipping container system, the shipping container system comprising: an outer sleeve blank formed from a single sheet of material, the outer sleeve blank comprising an outer sleeve base panel, an outer sleeve first side panel, an outer sleeve top panel, an outer sleeve side tab, an outer sleeve end closure, an outer sleeve slot panel, the outer sleeve slot panel further comprising an outer sleeve slot; wherein the outer sleeve blank is configured to be foldable into an outer sleeve, the outer sleeve comprising a tube having one open end, one substantially enclosed end, and an interior volume therein; an inner sleeve blank formed from a single sheet of material, the inner sleeve blank comprising an inner sleeve base panel, and inner sleeve side panel, and inner sleeve first end panel, an inner sleeve second end panel, an inner sleeve slot panel, and an inner sleeve slot; wherein the inner sleeve blank is configured to be foldable into an inner sleeve, the inner sleeve comprising a tray into which materials to be shipped can be placed, and wherein the inner sleeve is configured to be placeable within the interior volume of the outer sleeve such that the inner sleeve is reversibly moveable relative to the outer sleeve between a content accessible position and content inaccessible position within the outer sleeve; wherein when the inner sleeve is inserted into the interior of outer sleeve, the inner sleeve and outer sleeve cooperate to form a shipping container for the transport of material; and wherein the inner sleeve slot and outer sleeve slot are configured to receive an opener, the opener operative to permit a user to move the inner sleeve between the content accessible and content inaccessible positions.

In some embodiments, the outer sleeve blank and inner sleeve blank are constructed of at least one of paper, cardboard, plastic, metal and combinations thereof.

In some embodiments, the opener comprises a standard size credit card.

In some embodiments, the shipping container further comprises a latching mechanism releasable by the opener. In some embodiments the latching mechanism comprises an electrically operated latch and the opener comprises an RFID.

In the present disclosure there is also provide a method for using a secure shipping container system, the method comprising: providing an outer sleeve blank, the outer sleeve blank comprising an outer sleeve base panel, an outer sleeve first side panel, an outer sleeve top panel, an outer sleeve side tab, an outer sleeve end closure, an outer sleeve slot panel, the outer sleeve slot panel further comprising an outer sleeve slot, wherein the outer sleeve blank is configured to be foldable into an outer sleeve; folding the outer sleeve blank such that the outer sleeve comprises a tube having one open end, one substantially enclosed end, and an interior volume therein; providing an inner sleeve blank, the inner sleeve blank comprising an inner sleeve base panel, and inner sleeve side panel, and inner sleeve first end panel, an inner sleeve second end panel, an inner sleeve slot panel, and an inner sleeve slot, wherein the inner sleeve blank is configured to be foldable into an inner sleeve; folding the inner sleeve blank such that the inner sleeve comprises a tray into which materials to be shipped can be placed, and wherein the inner sleeve is configured to be placeable within the interior volume of the outer sleeve such that the inner sleeve is reversibly moveable relative to the outer sleeve between a content accessible position and content inaccessible position within the outer sleeve; placing materials to be shipped into the tray formed by the inner sleeve; inserting the inner sleeve into the interior of outer sleeve such that the inner sleeve is positioned in a content inaccessible position the combination of inner sleeve and outer sleeve thus forming a shipping container ready for transport; transporting the shipping container to a recipient; and providing instructions to the recipient on how to access the materials contained within the shipping container.

In some embodiments, the method further comprises constructing the outer sleeve blank and inner sleeve blank of at least one of paper, cardboard, plastic, metal and combinations thereof.

In some embodiments, the method further comprises providing the recipient with the opener.

In some embodiments, the method further comprises providing a shipping container having a latching mechanism releasable by the opener.

In some embodiments, the latching mechanism comprises an electrically operated latch, and the opener comprises an RFID included with the shipping container

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION OF THE INVENTION

The following discussion provides examples of embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed. Those of skill in the art will recognize that the described embodiment are examples of possible configurations of the invention and are not intended to be limiting to the scope of the invention. Accordingly, the drawings and descriptions contained herein are to be regarded as illustrative of the invention as set forth in the accompanying claims.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

The present invention, as described herein and in the accompanying figures comprises a secure shipping container. An exemplary embodiment of a shipping container comprises an outer sleeve 10*a* and an inner sleeve 20*a*, formed from foldable outer and inner sleeve blanks 10, 20 respectively. Examples of foldable blanks are depicted in FIGS. 1A and 1B.

Figure 1A:
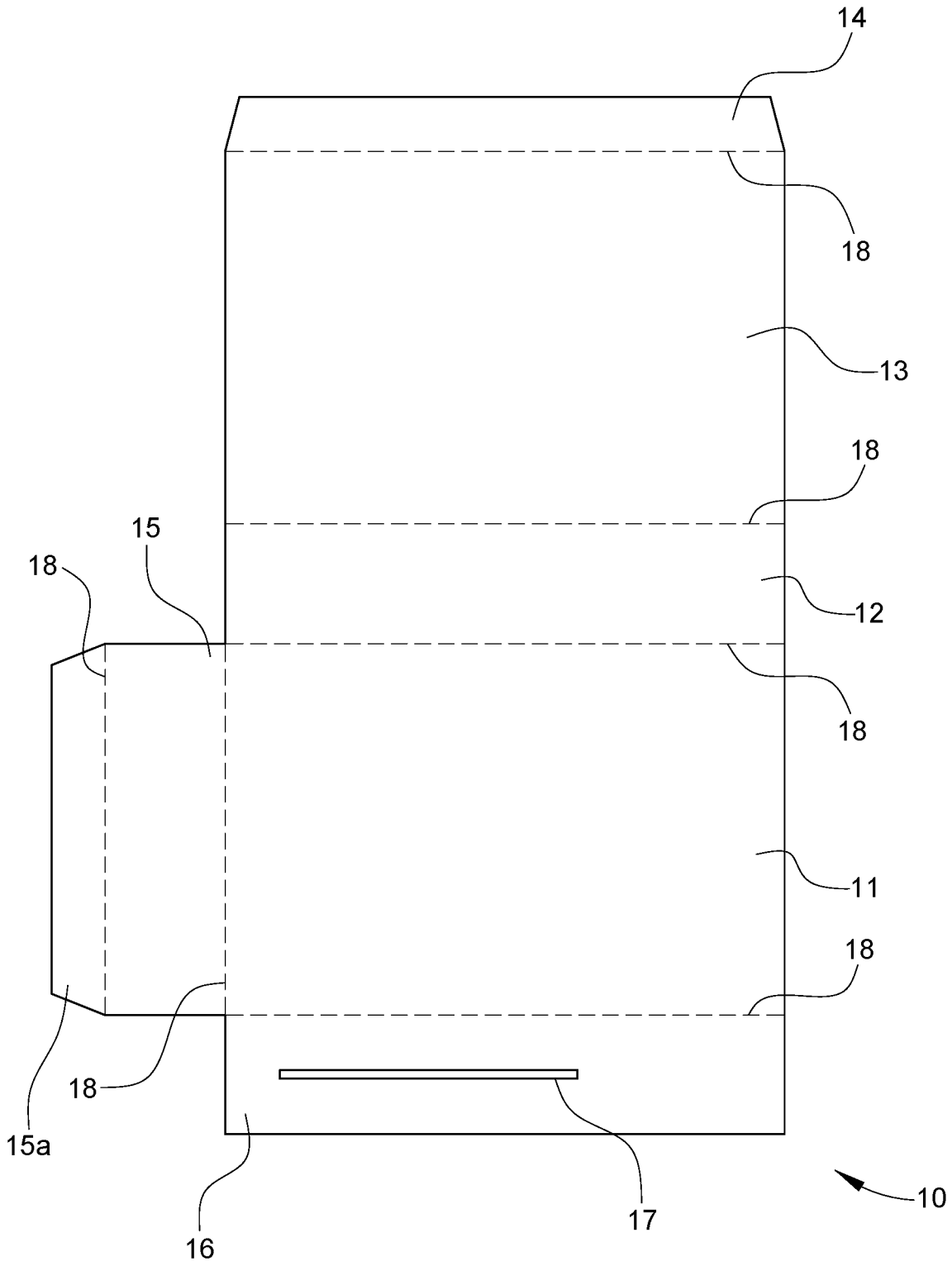
FIG. 1A is a view of an embodiment of a foldable blank prior to folding into an outer sleeve according to the present disclosure.

A shown in FIG. 1A, an outer sleeve blank 10 comprises an outer sleeve base panel 11, an outer sleeve first side panel 12, an outer sleeve top panel 13, an outer sleeve side tab 14, an outer sleeve end closure 15, and an outer sleeve slot panel 16. The outer sleeve slot panel further comprises an outer sleeve slot 17.

Figure 1B:
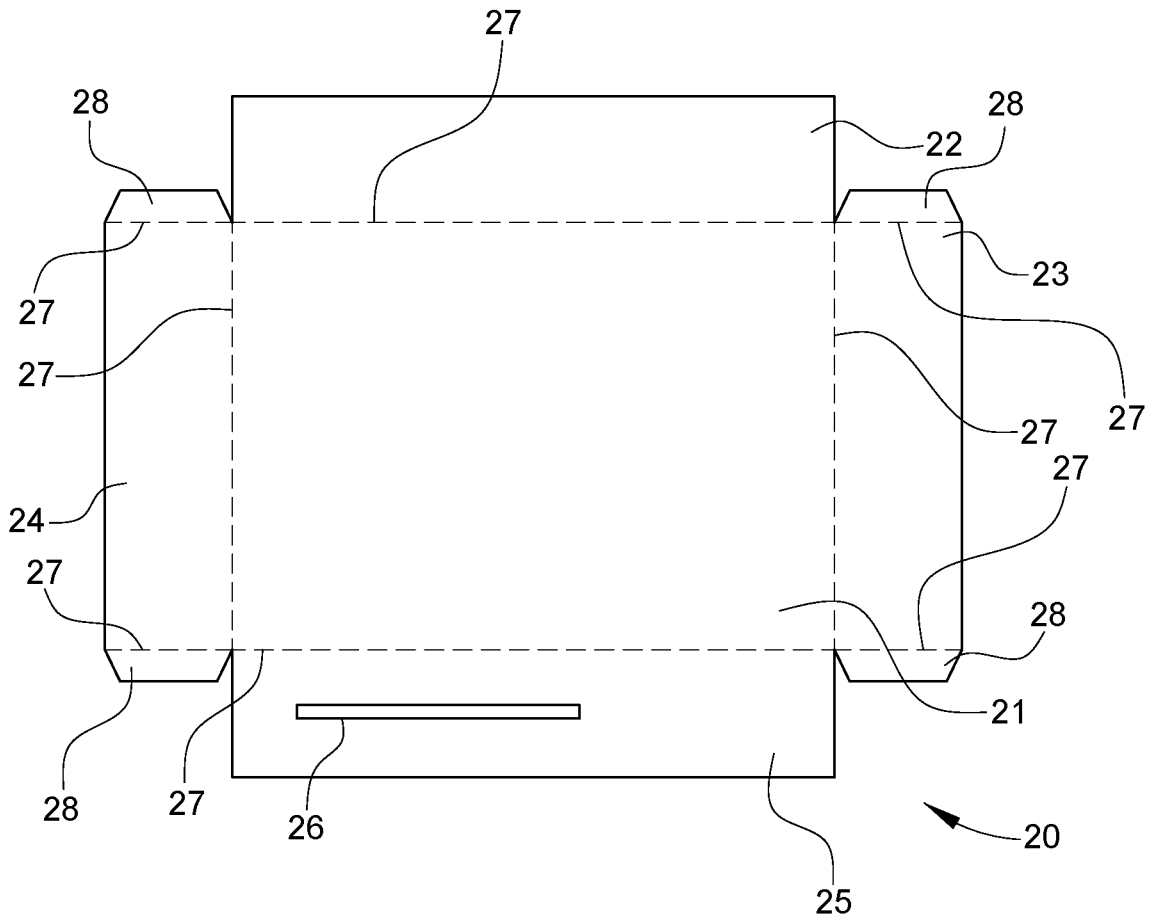
FIG. 1B is a view of an embodiment of a foldable blank prior to folding into an inner sleeve according to the present disclosure.

As shown in FIG. 1B, an inner sleeve blank 20 comprises an inner sleeve base panel 21, an inner sleeve side panel 22, an inner sleeve first end panel 23, an inner sleeve second end panel 24, an inner sleeve slot panel 25. The inner sleeve slot panel further comprises an inner sleeve slot 26, which in cooperation with the outer sleeve slot 17 is configured to allow a user to remove the inner sleeve 20*a* from the outer sleeve 10*a*, and thereby gain access to the contents of the shipping container as described below.

Figure 2A:
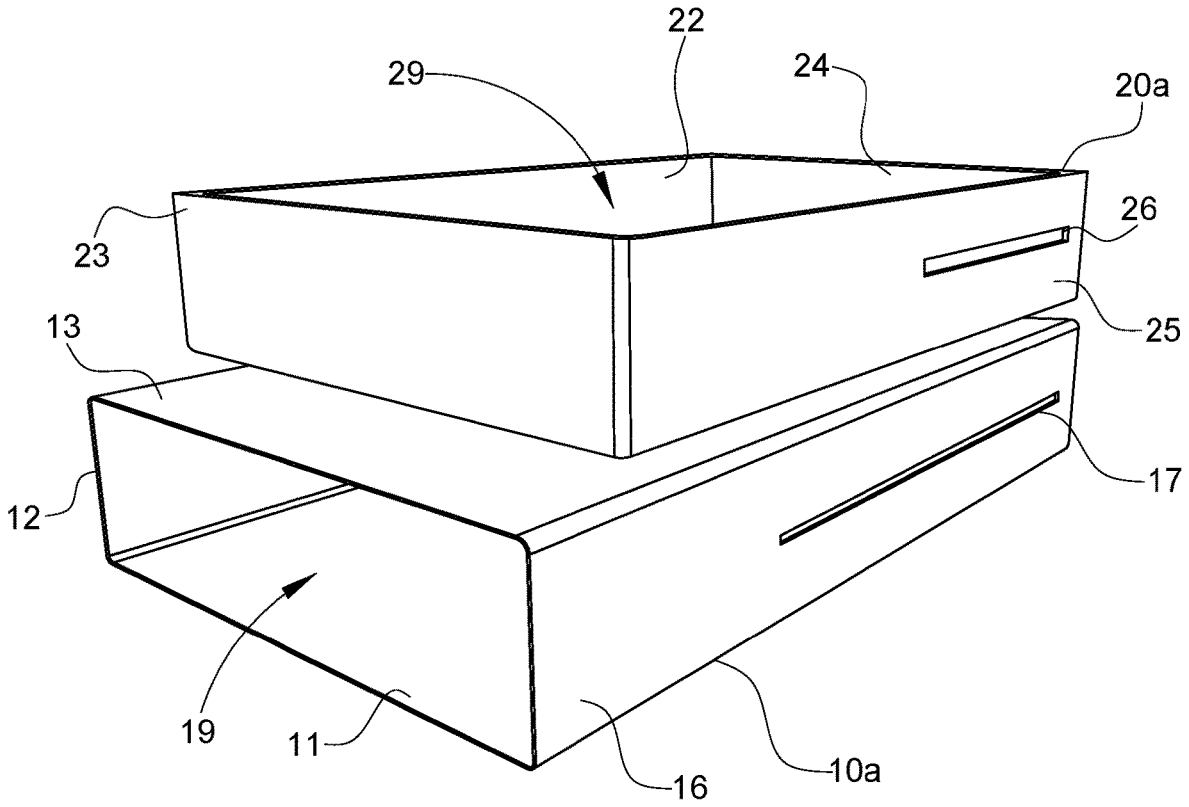
FIG. 2A is a perspective view of the blanks depicted in FIGS. 1A and 1B after folding each into a desired configuration according to the present disclosure, and prior to placing materials to be shipped into the inner sleeve and prior to insertion of the inner sleeve into the outer sleeve.

Conveniently, the outer sleeve blank 10 is foldable along outer sleeve fold lines 18, to form the finished outer sleeve 10*a* and the inner sleeve blank 20 is foldable along inner sleeve fold lines 27 to form the finished inner sleeve 20*a*, as depicted in FIG. 2A.

One embodiment of a method for folding an outer sleeve blank 10 into an assembled outer sleeve 10*a* is as follows. The outer sleeve first panel 12, is folded at a fold line 18 until approximately a right angle is formed between the outer sleeve first panel 12 and the outer sleeve base panel 11. The outer sleeve blank 10 is then folded at a fold line 18 between the outer sleeve first panel 12 and the outer sleeve top panel 13 such that the planes of the outer sleeve base panel 11 and outer sleeve top panel 13 are substantially parallel. The outer sleeve side tab 14 is then folded along a fold line 18 and secured to the inner surface of the outer sleeve slot panel 16, thus forming at this stage a tube with openings at each end. Next, the outer sleeve end closure 15 and tab 15*a* are folded inwards towards what will become the interior of the outer sleeve 10*a*, thus enclosing one end of the finished outer sleeve 10*a*, the other end remaining open to provide access to the interior of the outer sleeve 19, and into which to eventually insert the inner sleeve 10*a*.

The dimensions of the outer sleeve end closure 15 can be sized such that it completely closes an end of the finished outer sleeve 10*a*. Tab 15*a* is configured to be secured to the surface of the outer sleeve top panel 13 that is facing the interior 19 of the assembled outer sleeve 10*a*. Tab 15*a* can be secured in place by any of a variety of methods, fasteners and/or adhesives known to those of skill in the art. In this exemplary embodiment, the completed outer sleeve 10*a* can be seen to form a substantially rectangular tube having a top, bottom, sides, one closed end and one open end that provides access to the interior of the outer sleeve 19.

Similarly, an embodiment of a method for folding an inner sleeve blank 20 into a completed inner sleeve 20*a*, is as follows. Inner sleeve side panel 22, inner sleeve first end panel 23, inner sleeve second end panel 24, and inner sleeve slot panel 25, are folded in the same direction such that each will form substantially a right angle relative to the plane of the inner sleeve base panel 21. Inner sleeve first end panel 23 and inner sleeve second end panel 24 can be secured to the inner sleeve side panel 22 and inner sleeve slot panel 25 by tabs 28. Tabs 28 can be secured in place by any of a variety of methods, fasteners and/or adhesives known to those of skill in the art.

In this exemplary embodiment, the finished inner sleeve 20*a* forms a tray with having a base, sides, and ends, and an open top 29 providing access into the interior of the inner sleeve 20*a*, and into which materials to be shipped in the assembled container can be placed prior to inserting the inner sleeve 20*a* into the outer sleeve 10*a*.

While the exemplary embodiments of an outer and inner sleeve shown herein are rectangular in cross-sectional profile, the scope of the invention is not limited to shipping containers only of a rectangular shape. Those of skill in the art will recognize that shipping containers might be formed having round, elliptical, triangular, square, or any other number of sides and will still operate as a secure shipping according to the present disclosure.

Figure 2B:
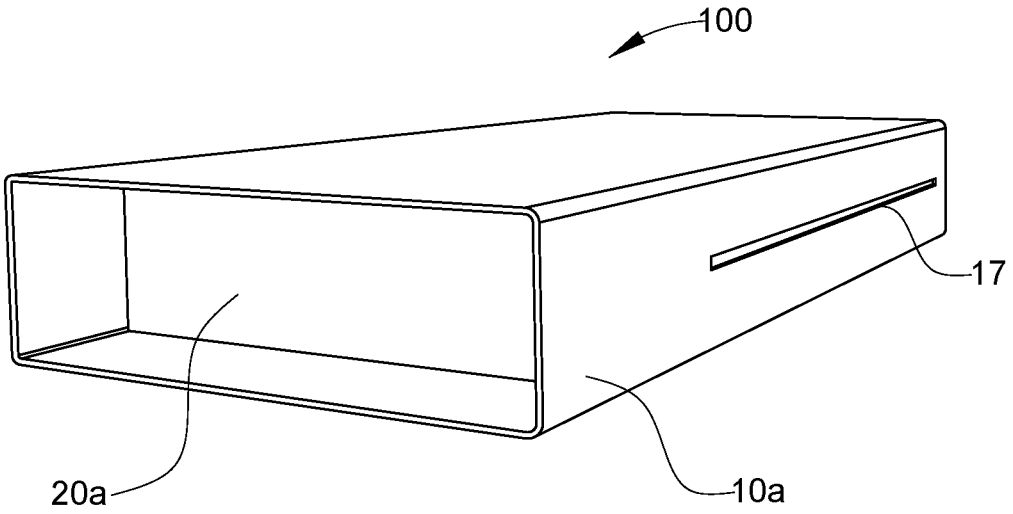
FIG. 2B is a perspective view of an embodiment of a shipping container according to the present disclosure, where the inner sleeve is inserted into the outer sleeve, and the container is in a configuration suitable for shipment.
Figure 3A:
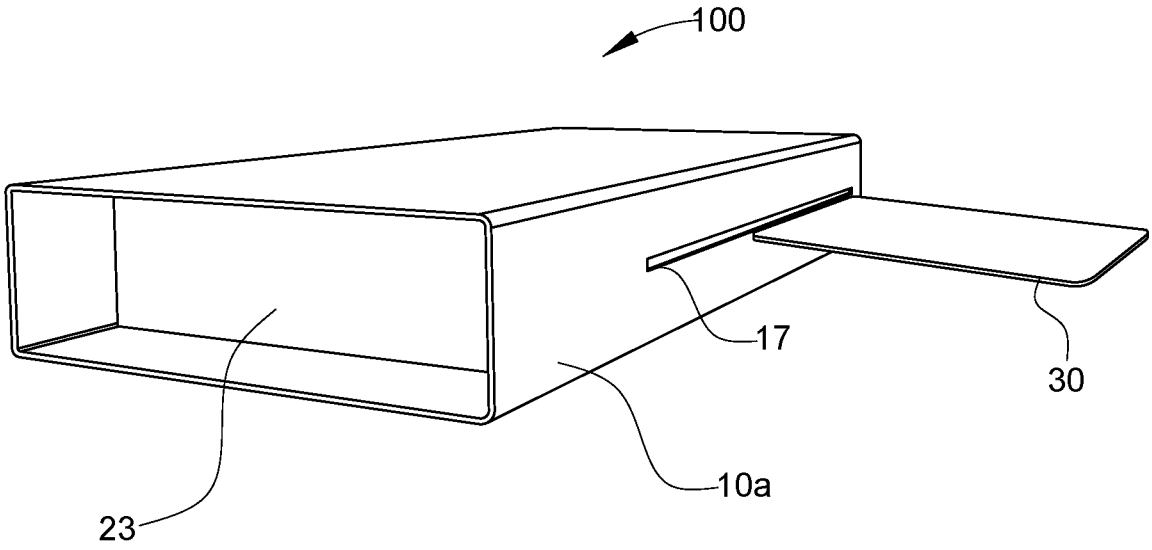
FIG. 3A is a perspective view of an embodiment of a shipping container according to the present disclosure wherein the inner sleeve is inserted into the outer sleeve and wherein the shipping container is about to be opened by a method as described herein.
Figure 3B:
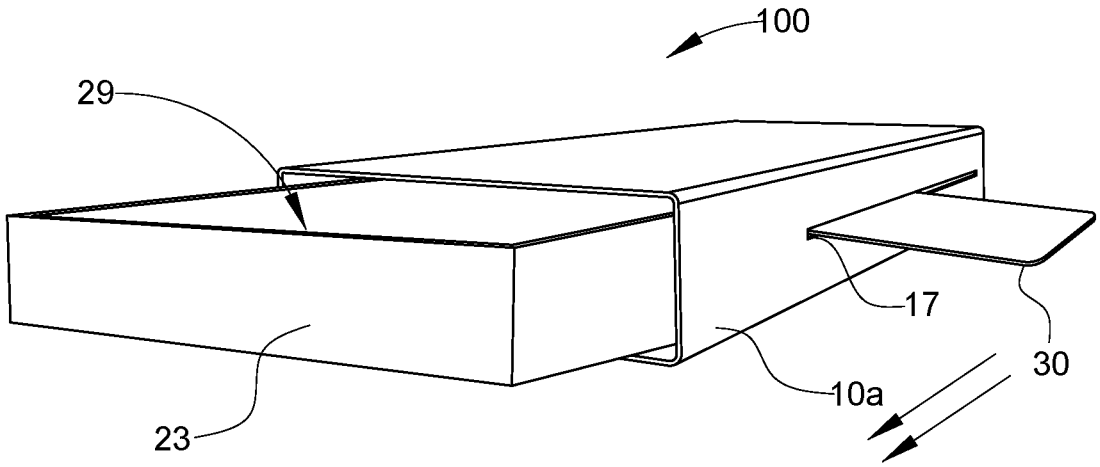
FIG. 3B is a perspective view of an embodiment of the container depicted in FIG. 3A where the inner sleeve has been partially removed from the outer sleeve according to a method of the present disclosure such that the contents of the shipping container are accessible.

Following folding of the inner and outer sleeve blanks into the inner and outer sleeves, one can assemble these two components into a finished shipping container 100. In one embodiment, a user will place material desired to be shipped securely into the interior of the inner sleeve 29, as depicted by the arrow and reference numeral in FIG. 2A. The inner sleeve 20*a* can then be inserted into the open end 19 of the outer sleeve 10*a* to as shown in FIG. 2B. The inner sleeve 20*a* will be inserted such that the inner sleeve slot 26 and outer sleeve slot 17 are positioned on the same side of the shipping container 100, and such that the inner sleeve slot 26 and outer sleeve slot 17 will be in substantial alignment with each other. It can also be seen from the example shown in FIG. 2B that the length of the inner sleeve 20*a* is preferably less than that of the outer sleeve 10*a*, so that when the inner sleeve 20*a* is inserted into the outer sleeve 10*a*, the inner sleeve first end panel 23 is recessed, as depicted in FIGS. 3A and 3B. For clarity, reference numeral 20*a* in FIG. 2B is meant to refer to the entire inner sleeve positioned within the outer sleeve 10*a*. In FIGS. 3A and 3B, reference numeral 23 is meant to refer to the inner sleeve first end panel by itself.

There being no means with which to grasp the recessed surface of the inner sleeve first end panel 23, the inner sleeve 20*a* is now securely situated within the outer sleeve 10*a*. In some embodiments, the inner sleeve 20*a* is sized such that frictional forces between the external surfaces of the inner sleeve 20*a* contacting the internal surfaces of the outer sleeve 10*a* are sufficient to maintain the inner sleeve 20*a* securely within the outer sleeve 10*a*. In some cases, however, it may be further desirable to include fasteners and/or adhesives to better secure the inner sleeve 20*a* within the interior of the outer sleeve 10*a* in order to prevent the inner sleeve 20*a* from inadvertently sliding out of the outer sleeve 20*a* once it has been inserted.

As described above, when the inner sleeve 20*a* is inserted into the outer sleeve 10*a*, the inner sleeve slot 26 and outer sleeve slot 17 will be substantially aligned with each other. Removal of the inner sleeve 20*a* from the outer sleeve 10*a* can accomplished by means of manipulation of the inner sleeve 20*a* via the outer sleeve slot 17 and inner sleeve slot 26 with an opener 30. As shown in FIG. 3A, in one method for removal of the inner sleeve 20*a* from the outer sleeve 10*a*, the opener 30 is positioned such that it can be inserted into the outer sleeve slot 17. The opener 30 is then inserted into outer sleeve slot 17 and also through the aligned inner sleeve slot 26 such that the inner sleeve slot 26 is engaged by the opener 30. As shown in FIG. 3B, the user then moves the opener 30 forward towards the open end 19 of the outer sleeve 10*a*. Because the outer sleeve slot 17 is sized to have a length greater than that of the inner sleeve slot 26, the effect of moving the opener 30 is to slide the inner sleeve 20*a* towards the open end 19 of the outer sleeve 10*a*, as depicted in FIG. 3B. By moving the inner sleeve 20*a* a sufficient distance, the interior of the inner sleeve 29 is made accessible and the contents that had been previously placed within the inner sleeve 20*a* can be removed.

It will also be appreciated that the positioning of the slots as shown in the example are one possible location for them. The slots could be placed on either of the sides of the outer sleeve 10*a* and inner sleeve 20*a*. Alternatively, one could produce a shipping container 100 in which there is a single slot in the outer sleeve end closure 15 and removal of the inner sleeve 20*a* is accomplished by inserting an opener 30 in the slot and moving the inner sleeve 20*a* towards the open end of the outer sleeve 10*a* by applying a force to the inner sleeve second end panel 24, which in this example would not be required to have a slot.

Those of skill in the art will also appreciate that the inner sleeve 20*a* can be reversibly moved between a content inaccessible configuration (FIG. 3A) and a content accessible configuration (FIG. 3B), and any position therebetween. The inner sleeve 20*a* can also be completely removed from the outer sleeve 10*a* if desired. As the directional arrows show in FIG. 3B, the opener 30 can be used to move the inner sleeve 20*a* to a content accessible position. It will also be implicitly understood that the opener 30 can also operate to accomplish the reverse action, i.e. to move the inner sleeve 20*a* into the interior 19 of the outer sleeve 10*a* and to a content inaccessible position. Conveniently, the design of this shipping container makes it readily reusable.

The opener 30 can be any of a number of objects, the only criteria being that the opener is sized to be insertable into the outer sleeve slot 17 and able to engage the inner sleeve slot 26 to permit movement of the inner sleeve 20*a* relative to the outer sleeve 10*a*. In some embodiments conveniently, the slots 17, 26 are sized such that a typical credit card can be used as the opener 30. It will also be appreciated that other configurations and mechanisms are possible for the slots 17, 26 and opener 30. For example, the slots could be sized to admit a standard house or vehicle key, or other common tools. In some embodiments, it may be possible to include a sensor mechanism and latch or lock such that the lock is released when a card with the appropriate signaling device is inserted into the slot in the sleeves. Such as signaling device may comprise an RFID chip or other commonly electro-mechanical devices.

The embodiments shown in the present disclosure are rectangular in shape. However, it is also possible to design variants of the present invention where the inner and outer sleeves are tubes with circular, elliptical, oval, or other cross-section shapes, without departing from the inventive concept as described herein. The only requirement is that the cross-sectional shapes of the inner and outer sleeves are complimentary in form and sized such that the inner sleeve will be frictionally retained within the outer sleeve.

In terms of materials, a wide variety of materials may be used to fashion the components of the present invention. In some cases, the inner and outer sleeves may be made of cardboard or other rigid paper products, plastics, or metals, or combinations thereof. The components of the shipping container may also be secured in place with the use of fasteners and/or adhesives of various kinds known in the art.

Those of skill in the art will recognizes there are a number of variants that can be fashioned but which incorporated the essential features of the invention as described herein. It will be apparent to those skilled in the art that many more modifications besides those already described are possible without departing from the inventive concepts herein.

What is claimed is:

1. A child-proof shipping container, comprising:

an outer sleeve, the outer sleeve formed from an outer sleeve blank, the outer sleeve blank formed from a single sheet of material comprising:

an outer sleeve base panel, an outer sleeve first side panel, an outer sleeve top panel, an outer sleeve side tab, an outer sleeve end closure, an outer sleeve slot panel, the outer sleeve slot panel further comprising an outer sleeve slot;

wherein the outer sleeve blank is configured to be foldable, and when folded, to form said outer sleeve, the outer sleeve comprising a tube having one open end, one substantially enclosed end, the outer sleeve slot, and an interior volume therein;

an inner sleeve, the inner sleeve formed from an inner sleeve blank, the inner sleeve blank formed from a single sheet of material comprising:

a single sheet of material, the inner sleeve blank comprising an inner sleeve base panel, and inner sleeve side panel, and inner sleeve first end panel, an inner sleeve second end panel, an inner sleeve slot panel, and an inner sleeve slot;

wherein the inner sleeve blank is configured to be foldable, and when folded, to form said inner sleeve, the inner sleeve comprising an open-top tray into which materials to be shipped can be placed, the inner sleeve slot, and wherein the inner sleeve is configured to be placeable within the interior volume of the outer sleeve such that the inner sleeve is reversably moveable relative to the outer sleeve between a content accessible position and content inaccessible position within the outer sleeve;

wherein when the inner sleeve is inserted into the interior of the outer sleeve and positioned in the content inaccessible position the inner sleeve slot and outer sleeve slot are substantially aligned with each other, and the inner sleeve and outer sleeve cooperate to form the child-proof shipping container;

wherein the inner sleeve slot has a length and a width, and the outer sleeve slot has a length and a width, and wherein when in the content inaccessible position, the entire length of the inner sleeve slot is in register with at least a portion of the length of the outer sleeve slot;

wherein the length and width of the of each of the inner sleeve and outer sleeve slots are configured to permit insertion of an opener;

wherein the length of the outer sleeve slot is greater than the length of the inner sleeve slot, such that when the opener is inserted into the outer sleeve slot and inner sleeve slot, the opener can engage the inner sleeve slot and permit a user to apply a force sufficient to slidably move the opener along the length of the outer sleeve slot such that the inner sleeve can be moved from the content inaccessible to the content accessible position.

2. The child-proof shipping container of claim 1, wherein the inner sleeve and outer sleeve are maintained in the content inaccessible position by friction between complimentary surfaces of the inner sleeve and outer sleeve.

* * * * *